US005932957A

United States Patent [19]

Ragland, Jr.

[11] Patent Number: 5,932,957

[45] Date of Patent: Aug. 3, 1999

[54] CATHODE-RAY TUBE HAVING DETENTIONING ROD ASSEMBLY FOR A TENSION MASK FRAME

[75] Inventor: Frank Rowland Ragland, Jr., Lancaster, Pa.

[73] Assignee: Thomson Consumer Electronics, Inc., Indianapolis, Ind.

[21] Appl. No.: 08/844,471

[22] Filed: Apr. 18, 1997

[51] Int. Cl.[6] ..... H01J 29/07

[52] U.S. Cl. ..... 313/402; 313/404; 313/405; 313/407

[58] Field of Search ..... 313/402, 404, 313/407, 408

[56] References Cited

U.S. PATENT DOCUMENTS

| | | | |
|---|---|---|---|
| 3,772,555 | 11/1973 | McKee et al. | 313/85 S |
| 4,495,437 | 1/1985 | Kume et al. | 313/403 |
| 4,678,963 | 7/1987 | Fonda | 313/405 |
| 4,748,370 | 5/1988 | van den Broek | 313/404 |
| 5,041,756 | 8/1991 | Fairbanks | 313/407 |
| 5,045,010 | 9/1991 | Fairbanks | 445/30 |
| 5,111,107 | 5/1992 | Kume et al. | 313/405 |
| 5,113,111 | 5/1992 | Fairbanks | 313/404 |
| 5,214,349 | 5/1993 | Sakata et al. | 313/407 |
| 5,416,380 | 5/1995 | Horiuchi | 313/407 |
| 5,554,909 | 9/1996 | Brennescholtz | 313/402 |

FOREIGN PATENT DOCUMENTS

| | | | |
|---|---|---|---|
| 0206216 A1 | 12/1986 | European Pat. Off. | H01J 9/44 |
| 0393488 A2 | 10/1990 | European Pat. Off. | H01J 29/07 |
| 0709872A2 | 5/1996 | European Pat. Off. | H01J 29/07 |
| 2 727 568 | 5/1996 | France | H01J 31/12 |
| 58 152345 | 9/1983 | Japan | H01J 9/44 |

OTHER PUBLICATIONS

Patent Abstracts of Japan, vol. 007, No. 272 (E–214) Dec. 3, 1983 (Mitsubishi Denki KK), Sep. 9, 1983.

PCT International Search Report dated: Jul. 17, 1998.

*Primary Examiner*—Vip Patel
*Assistant Examiner*—Matthew J. Gerike
*Attorney, Agent, or Firm*—Joseph S. Tripoli; Dennis H. Irlbeck

[57] ABSTRACT

A cathode-ray tube includes a tension mask attached to a rectangular support frame assembly that has two long sides paralleling a central major axis thereof and two short sides paralleling a central minor axis thereof. The frame assembly includes two first members, having oppositely disposed ends, paralleling the major axis, and two resilient U-shaped second members, having a first leg and a second leg attached to the oppositely disposed ends of the first members, paralleling the minor axis. Each of the first members has a compliant portion and a base portion. The mask is attached to the distal ends of the compliant portion. A detensioning rod assembly is disposed between the first and second legs of each of the second members to facilitate varying the tension of the mask.

5 Claims, 2 Drawing Sheets

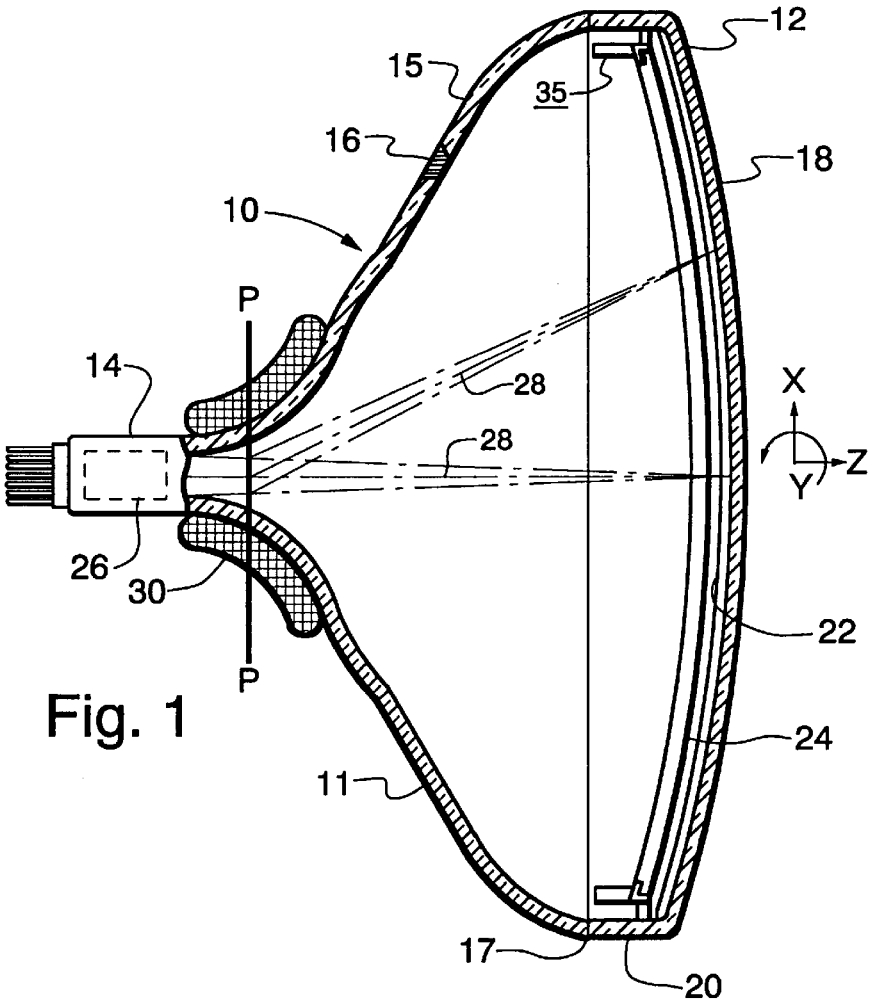
Fig. 1
Fig. 2
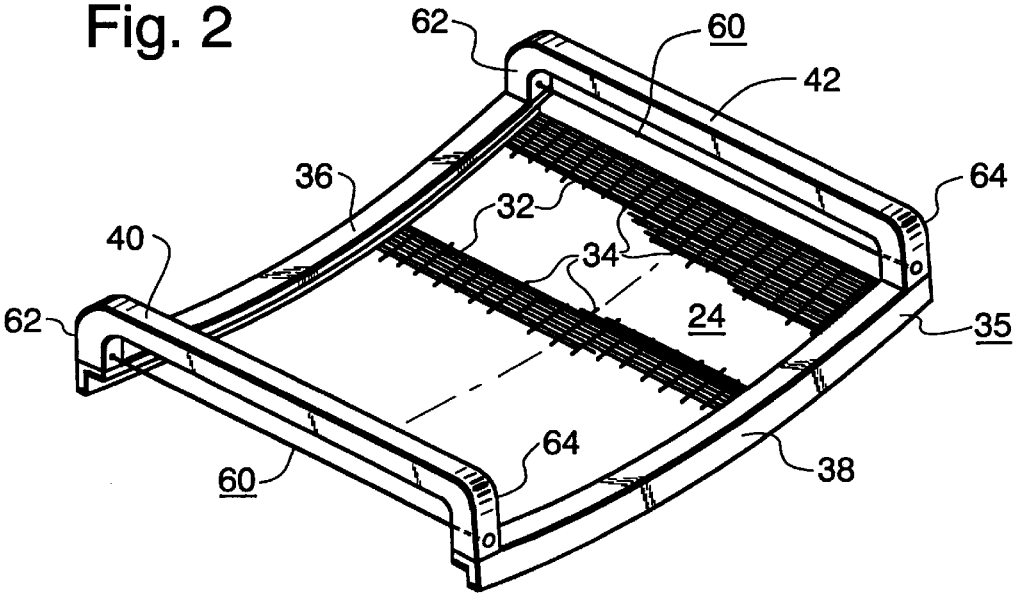

CATHODE-RAY TUBE HAVING DETENTIONING ROD ASSEMBLY FOR A TENSION MASK FRAME

The invention relates to color cathode-ray tubes (CRT's), such as color picture tubes (CPT's) and color display tubes (CDT's), and particularly to a method of operating the CRT's to permanently structurally alter an internal component in a localized area thereof.

BACKGROUND OF THE INVENTION

A color cathode-ray tube (CRT) includes an electron gun for generating and directing three electron beams to a screen of the tube. The screen is located on the inner surface of a cylindrical faceplate of the tube and is made up of an array of elements of three different color emitting phosphors. A color selection electrode is interposed between the gun and the screen to permit each electron beam to strike only the phosphor elements associated with that beam. The color selection electrode may be a tension mask or a tension focus mask. The tension mask comprises a thin sheet of metal, such as steel, that is contoured to somewhat parallel the inner surface of the cylindrical faceplate of the tube. The tension mask generally comprises parallel strands of wire attached to a relatively massive support frame which maintains tension on the strands. The tension focus mask comprises dual sets of conductive strands that are perpendicular to each other and usually separated by an insulative layer. The first set of strands is identical to those described with respect to the focus mask. The second set comprises cross strands electrically insulated from the strands of the first set.

In either type of color selection electrode, it is necessary that the strands of the tension mask are attached to the support frame, and that the tension be maintained during operation of the tube. A drawback of prior support frames is that during the thermal processing cycle, in which the faceplate panel is sealed to the funnel of the tube, the sealing temperature, which is in the range of about 440–460° C., causes a permanent elongation, or "creep" of the mask strands which lowers the tension in the strands during normal tube operation. High strand tension during operation is desirable for good microphonic performance and to absorb the thermal expansion of the strands due to heating by the electron beam during normal operation. The heating during normal operation generally raises the temperature of the tension mask to less than about 65° C.

U.S. Pat. No. 5,111,107, issued to Kume et al. on May 5, 1992, describes a stainless steel structural element that is attached to the underside of the portion of each of the resilient members of the support frame. The stainless steel structural element has a larger thermal coefficient of expansion than the resilient frame member to which it is attached. During thermal processing of the mask and tube, the stainless steel element expands causing the frame to bow in a manner that reduces the tension in the mask and prevents creep of the mask strands. A drawback of the stainless steel structural element is that it does not precisely control the tension in the tension mask strands during thermal processing and the structural element adds additional cost and weight to the tube. Additionally, the attachment of the stainless structural element, by welding, increases the probability of a tube reject due to weld splash particles within the tube. Finally, the structural element may be subjected to localized heating, during tube operation, thereby inadvertently decreasing the tension in the tension mask strands and adversely affecting the microphonic performance of the tube. Accordingly, a more reliable, lower cost way of reducing tension in the mask strands, during processing, is desirable.

SUMMARY OF THE INVENTION

In accordance with the invention, a method is provided for operating a color cathode-ray tube in such a manner as to alter the structure of one of the internal components of the tube. The tube has a plurality of internal components including a luminescent screen, electron beam generating means spaced from the screen, and a color selection electrode assembly located between the electron beam generating means and the screen. A deflection yoke is disposed around the tube. The method comprises generating at least one electron beam and directing the beam to impinge on one of the internal components, thereby altering the structure of the impinged component in a localized area thereof.

BRIEF DESCRIPTION OF THE DRAWINGS

In the drawings:

FIG. 1 is a top view, partially in axial section, of a CRT embodying the invention;

FIG. 2 is a perspective view of a tension focus mask and support frame assembly;

DETAILED DESCRIPTION OF THE PREFERRED EMBODIMENT

Figure 3:
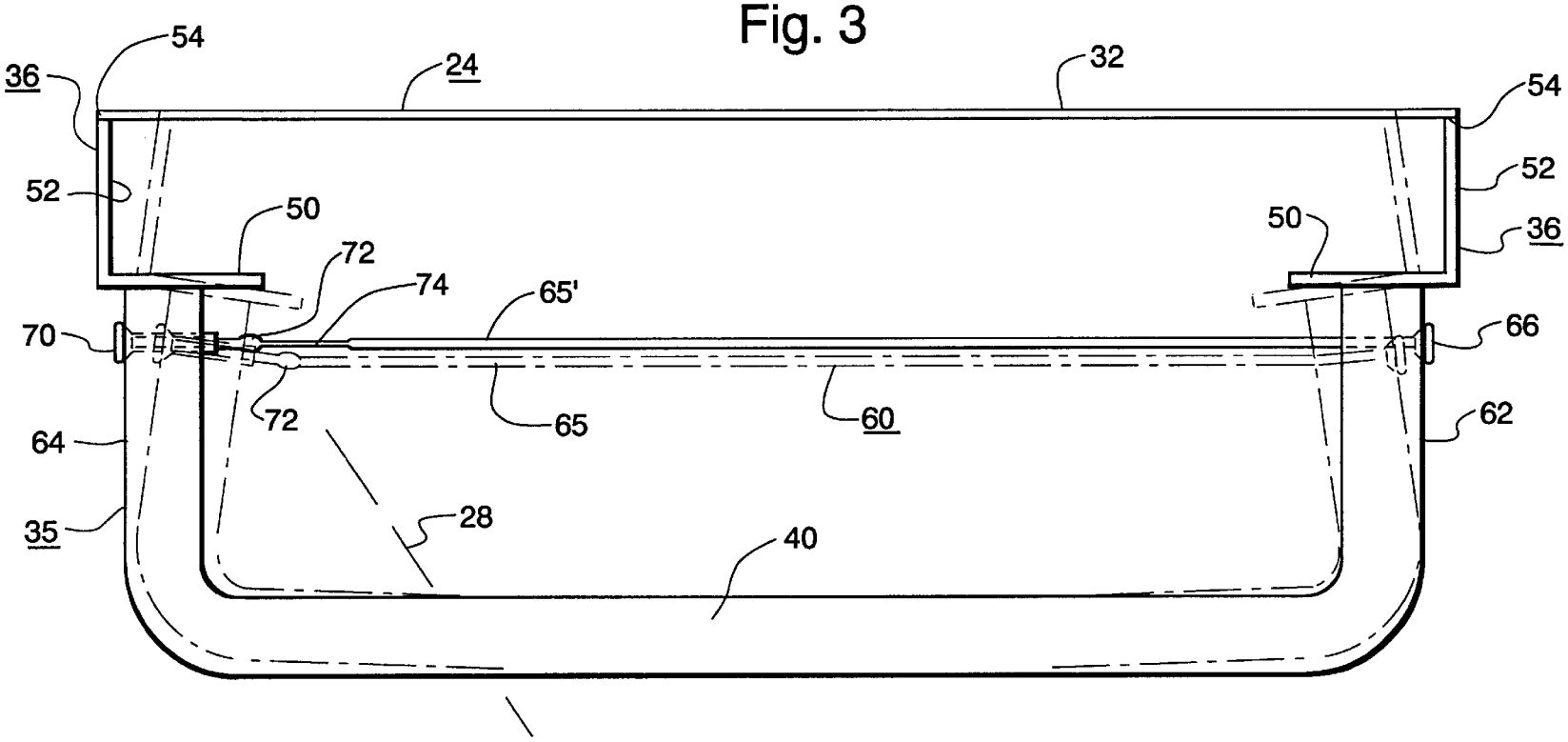
FIG. 3 is a side view of the tension focus mask and support frame assembly of FIG. 2, showing the support frame assembly under tension and, in phantom, detensioned by a novel detensioning rod assembly.

FIG. 1 shows a CRT 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The panel 12 comprises a substantially cylindrical viewing faceplate 18 and a peripheral flange or sidewall 20, which is sealed to the funnel 15 by a glass frit 17. A three-color phosphor screen 22 is carried on the inner surface of the faceplate 18. The screen 22 is a line screen with the phosphor lines arranged in triads, each triad including a phosphor line of each of the three colors. A substantially cylindrical multi-apertured color selection electrode 24 is removably mounted in predetermined spaced relation to the screen 22. Preferably, the color selection electrode 24 is either a tension mask or a tension focus mask; however, a shadow mask also is within the scope of this invention. An electron gun 26, shown schematically by dashed lines in FIG. 1, is centrally mounted within the neck 14 to generate and direct three inline beams, not shown, along convergent paths through openings in the mask 24 to the screen 22.

The CRT 10 is designed to be used with an external magnetic deflection yoke, such as the yoke 30, disposed around a portion of the CRT, in the vicinity of the funnel-to-neck junction. When activated, the yoke 30 subjects the three beams to magnetic fields which cause the beams to scan horizontally and vertically in a rectangular raster over the screen 22. The initial plane of deflection is shown by the line P—P in FIG. 1.

Figure 4:
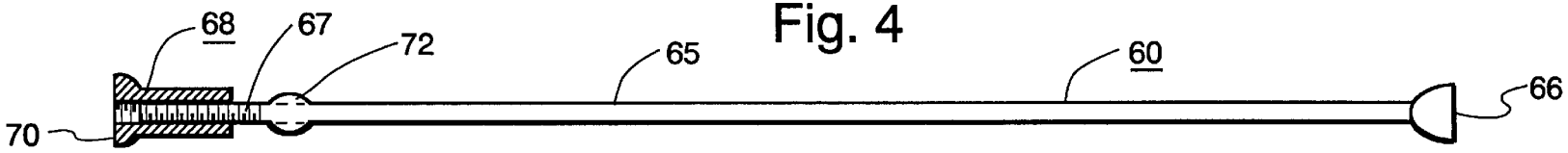
FIG. 4 is a perspective view of the novel detensioning rod assembly used in the present invention.

The tension mask, shown as a tension focus mask 24 in FIG. 2, includes a plurality of metal strands 32 and cross wires 34 that are insulated from the metal strands. A support frame assembly 35 is substantially rectangular and includes two long sides comprising first members 36 and 38 paralleling the major axis, and two short sides comprising resilient U-shaped second members 40 and 42 attached to the ends of the first members 36, 38 and paralleling the minor axis. The tension focus mask 24 has a substantially cylindrical contour, being curved along the major axis and straight along the minor axis. As shown in FIG. 3, each of the first members 36 has a base portion 50 and an upstanding compliant portion 52 that includes a distal end 54. The strands 32 of the mask 24 are attached between the distal ends 54 of the compliant portions 52. Each of the resilient U-shaped second members 40 and 42 includes a detensioning rod assembly 60 that is disposed between a first leg 62 and a second leg 64, for detensioning the strands 32 of the mask 24 during thermal processing of the tension mask 24 and the CRT 10. With reference to FIG. 4, the detensioning rod assembly 60 includes a threaded detensioning rod 65 which is enlarged at a first end 66. A second end 67 is threaded to receive a retaining member 68 which also is enlarged at one end 70 thereof. As shown in phantom in FIG. 3, the rod 65 is disposed through an opening, not shown, in one of the legs, such as first leg 62. The retaining member 68 is inserted through an opening, also not shown, in the second leg 64 and screwed onto the threaded end 67 of the rod 65. The enlarged ends 66 and 70 of the rod 65 and the retaining member 68, respectively, hold the retaining rod assembly 60 between the two legs 62 and 64. A phosphor marker 72 is provided near one end of each of the detensioning rods 65 for a purpose to be described hereinafter. A tensioning jig, not shown, engages the compliant portions 52 of the first members 36 and moves the portions 52 towards each other to facilitate attachment of the tension mask 24 between the distal ends 54 of the compliant portions 52. The retaining rod assemblies 60 are then tightened to secure the first and second legs 62 and 64, respectively, of the resilient U-shaped members 40 and 42 in position, as shown by the phantom lines of FIG. 3. The mask 24 and support frame assembly 35 are mounted within the faceplate panel 12, as is known in the art, and the panel 12 is frit sealed to the funnel 15 at a sealing temperature within the range of about 440–460° C. The diameter of the detensioning rod 65 is chosen so that when the mask 24 is properly detensioned, the stress in the rod 65, at 460° C., will be below the value at which the rod will creep. After frit sealing, the tube is evacuated and made operable. Then, at least one electron beam 28 is guided, using the yoke 30, to impinge on the rod 65 only in the vicinity of the phosphor marker 72. The power in the electron beam 28 is increased to heat a section of the rod 65 to a temperature within the range of 800–1000° C., where the heated section 74 of the rod 65 yields, stretches, or lengthens, and necks-down, as shown in FIG. 3, to restore tension in the mask 24. The phosphor marker 72 is positioned to that emission given off when the electron beam 28 strikes the marker 72 is visible through the sidewall of the panel 12. The phosphor marker 72 also is positioned so that if the electron beam 28 misses the rod 65, the beam will impinge on the overhanging base portion 50 of the first member 36. The direction of the electron beam 28 is indicated in FIG. 3. The preferred material for the detensioning rod 65 is CARTECH PYROMET ALLOY 882®, available from Carpenter Technology Corp., Reading, Pa. The rod 65 has a diameter of about 2 mm.

While the invention has been described in the embodiment of a tension focus mask 24, support frame assembly 35 and detensioning rod assembly 60, it is within the scope of the present invention to utilize the electron beam 28 in a conventional shadow mask-type CRT to locally heat the shadow mask and cause doming of the mask, to permanently correct any minor distortion in the contour thereof within the locally heated area. This embodiment of the invention is different from, and not suggested by, the uniform expansion of the shadow mask caused by the impingement of the three scanning electron beams during normal tube operation. Additionally, the electron beam 28 may be used to impinge upon localized areas of any of the aforementioned types of color selection electrodes to permanently remove extraneous material, either conductive or insulative, therefrom, thereby cleaning the mask, especially in the areas adjacent to the mask openings.

What is claimed is:

1. In a color cathode-ray tube having an envelope with a deflection yoke disposed around a portion thereof, said tube having therein a plurality of internal components including an electron gun for generating and directing at least one electron beam, a luminescent screen, and a tension focus mask attached to a support frame assembly, in proximity to said screen, said mask and said support frame assembly being rectangular and having two long sides paralleling a central major axis thereof and two short sides paralleling a central minor axis thereof, said mask having a substantially cylindrical contour, being curved along one of said axes, said frame including two first members, having two oppositely disposed ends, paralleling said major axis, and two resilient U-shaped second members, having a first leg and a second leg, attached to the oppositely disposed ends of said first members, paralleling said minor axis, each of said first members having a compliant portion and a base portion, and said mask being attached to the distal ends of said compliant portion, the improvement comprising, a detensioning rod assembly disposed between said first and second legs of each of said second members to facilitate varying the tension of said mask.

2. The tube as defined in claim 1, wherein said detensioning rod assembly includes a detensioning rod having an enlarged first end and a threaded second end disposed within a retaining member.

3. The tube as defined in claim 2, wherein said detensioning rod assembly further includes a marker to detect said electron beam.

4. The tube as defined as claim 2, wherein said retaining member has an enlarged end.

5. The tube as defined in claim 4, wherein said enlarged end of said retaining member and said enlarged end of said detensioning rod contact said first and second legs of said second members to retain said detensioning rod assemblies therebetween.

* * * * *

UNITED STATES PATENT AND TRADEMARK OFFICE

CERTIFICATE OF CORRECTION

PATENT NO. : 5,932,957
DATED : August 3, 1999
INVENTOR(S) : Frank Rowland Ragland, Jr.

It is certified that error appears in the above-identified patent and that said Letters Patent is hereby corrected as shown below:

Title page,
Item [56], References Cited, U.S. PATENT DOCUMENTS, please add the following reference:
-- 2,795,719 6/57 Morrell . . . . . 313/85 --.

Column 4,
Line 27, after "tension", delete "focus".

Signed and Sealed this

Twenty-fourth Day of December, 2002

JAMES E. ROGAN
*Director of the United States Patent and Trademark Office*